US005590674A

United States Patent [19]

Eppenbach

[11] Patent Number: 5,590,674

[45] Date of Patent: Jan. 7, 1997

[54] TENT AND TENT POLE SYSTEM

[76] Inventor: Lawrence C. Eppenbach, 119 Seward St., Juneau, Ak. 99801-1268

[21] Appl. No.: 539,530

[22] Filed: Oct. 3, 1995

[51] Int. Cl.[6] ..... E04H 15/40

[52] U.S. Cl. ..... 135/114; 135/127; 135/125; 135/130; 135/156; 248/160

[58] Field of Search ..... 248/160; D21/254; 135/114, 139, 125, 126, 127, 130, 131, 156, 144, 145

[56] References Cited

U.S. PATENT DOCUMENTS

| | | | |
|---|---|---|---|
| D. 289,787 | 5/1987 | Eppenbach . | |
| 2,784,261 | 3/1957 | Anklesaria | 248/160 X |
| 4,033,536 | 7/1977 | Hillstrom | 248/160 |
| 4,165,757 | 8/1979 | Marks | 135/125 X |
| 4,236,543 | 12/1980 | Moss | 135/127 X |
| 4,636,109 | 1/1987 | Clausen et al. | 248/160 X |
| 4,706,696 | 11/1987 | Gillis | 135/127 |
| 4,723,371 | 2/1988 | Williams . | |
| 4,750,509 | 6/1988 | Kim . | |
| 4,827,958 | 5/1989 | Cantwell et al. | 135/127 |
| 4,858,635 | 8/1989 | Eppenbach . | |
| 4,979,531 | 12/1990 | Toor et al. | 135/127 |
| 5,008,793 | 4/1991 | Copeland | 248/160 X |
| 5,407,291 | 4/1995 | Hazinski et al. | 135/125 X |

FOREIGN PATENT DOCUMENTS

| | | | |
|---|---|---|---|
| 0087612 | 10/1959 | Denmark | 135/114 |
| 0739333 | 1/1933 | France | 135/114 |
| 1301414 | 7/1962 | France | 135/114 |
| 0177316 | 3/1922 | United Kingdom | 135/114 |

*Primary Examiner*—Wynn E. Wood
*Attorney, Agent, or Firm*—Richard L. Myers

[57] ABSTRACT

A tent pole comprising first and elongated pole sections. One end portion of the first pole section has cavity and one end portion of the second pole section is receivable in the cavity. A coil spring extends over regions of the end portions of the outer surfaces of the first and second pole sections. The coil spring is coupled to the first and second pole sections so as to resiliently resist axial separation of the pole sections. The coil spring is sufficiently flexible so that the coil spring can be folded to allow the first and second pole sections to be in side-by-side relationship.

22 Claims, 2 Drawing Sheets

TENT AND TENT POLE SYSTEM

BACKGROUND OF THE INVENTION

A tent typically comprises a frame and a flexible sheet supported by the frame to provide at least a partial enclosure. The frame typically includes tent poles, and each of the tent poles may include a plurality of pole sections. To erect the tent, the tent pole sections are coupled together in end to end relationship, and in the process of taking the tent down, the tent pole sections are disconnected.

In one common tent pole fastening system, each of the pole sections includes an elongated member or rod and a ferrule attached to one end of the elongated member. The ferrule provides an axially opening cavity which receives and frictionally retains an end portion of an adjacent pole section. This fastening system is not completely satisfactory because, for example, the frictional force of the ferrule on the adjacent pole section may be too tight thereby making assembly and disassembly of the pole sections difficult or too loose in which event the pole sections may separate during erection of the tent. In addition, when disassembled, the pole sections are not interconnected and are easily lost.

To address these problems, it is known to use a shock cord fastening system for the pole sections. This shock cord system, which is described more completely hereinbelow in connection with prior art FIG. 1, employs pole sections which have an axial passage running completely through each of the pole sections. An elongated resilient cord extends through the passages of each of the pole sections of each tent pole to resiliently retain the pole sections together. With this construction, when one end portion of a pole section is telescopically received in the cavity formed by the ferrule of the adjacent pole section, the resilient member resiliently retains these pole sections in this relationship. The resilient member is sufficiently flexible so that when these end portions are not in relationship, the resilient member can be folded to allow the first and second pole sections to be in side by side relationship.

One drawback of the shock cord system is that it requires that each of the pole sections have an axial passage extending completely through it. Consequently, the shock cord system cannot be used for pole sections which are solid, i.e. those which are devoid of a passage extending axially completely through the pole section. In addition, some tent poles have a cross section which is too small to allow the formation of an axial passage of sufficient size to accommodate the resilient cord consequently, the application of the shock cord system is limited.

SUMMARY OF THE INVENTION

This invention provides a tent pole which generally overcomes the disadvantages noted above in the prior art. This invention can be applied to tent pole sections whether or not each of the pole sections has a passage extending axially completely through it. Thus, this invention has a wide range of applications.

For example, this invention may be utilized with a tent pole which comprises first and second elongated pole sections, and these pole sections may or may not have a passage extending axially completely through them. One end portion of the first pole section has a cavity which opens axially at one end of the first pole section and one end portion of the second pole section is receivable in the cavity.

A resilient member is coupled to the first and second pole sections so that when one end portion of the second pole section is received in the cavity, the resilient member resiliently retains such one end portion of the second pole section in the cavity and will also allow such one end portion to be axially withdrawn from the cavity against the biasing force of the resilient member. However, unlike the shock cord fastening system, the resilient member of this invention extends over portions of the outer surfaces of the first and second pole sections adjacent one end of the first pole section. Because the resilient member is at least to this extent external of the pole sections, the presence or absence of an internal axially extending passage in each of the pole sections is immaterial. The resilient member is sufficiently flexible so that when the one end of the second pole section is withdrawn from the cavity, the resilient member can be folded to allow the first and second pole sections to be in side-by-side relationship. Thus, this invention retains the advantages of the shock cord system while making these advantages applicable to a wider range of tent poles.

Although the resilient member can take various different forms, including one or more axially resilient cords, in a preferred construction, the resilient member includes a coil spring coupled to the first and second pole sections.

Various different techniques can be used to couple the resilient member to the pole sections so that it can perform its functions. For example, at least one of the pole sections may include an enlargement and the resilient member can advantageously be coupled to the enlargement. If the resilient member is or includes a coil spring, the coil spring preferably has at least one turn of reduced internal diameter which is engageable with the enlargement to couple the coil spring to the pole section.

Each of the pole sections preferably includes an elongated member. Preferably, the first pole section also includes a ferrule coupled to the elongated member and defining the cavity, and a second pole section preferably includes a sleeve affixed to the elongated member. Both the sleeve and the ferrule define enlargements to which the resilient member can be coupled. In the case of a coil spring, the spring preferably extends over at least portions of both the sleeve and the ferrule and has at least one turn of reduced internal diameter which is engageable with a shoulder formed by the ferrule and another turn of reduced internal diameter which is engageable with a shoulder formed by the sleeve. The sleeve is preferably spaced from the end of the elongated member of the second pole section which is received in the cavity and has a beveled end facing such one end of the second pole section. The facing one end of the elongated member of the second pole section is preferably smooth and rounded. This facilitates the insertion of this end into the cavity and reduces contact between it and the coil spring. This beveled end of the sleeve facilitates assembly of the tent pole sections during manufacturing.

For ease of assembly, the coil spring preferably loosely receives the sleeve. However, with the pole sections separated to extend the coil spring, the internal dimensions of the spring are reduced so the spring grips the sleeve to augment the attachment of the spring to the sleeve.

One important application of this invention is to tent pole sections which have too small a diameter to permit formation of an adequately sized passage for a shock cord. For example, this invention may be used with tent pole sections which have a diameter of no more than about 4.5 millimeters over a substantial length of the pole section. In this event, as in other cases as well, at least one and typically all of the pole sections are devoid of a passage extending axially completely through the associated pole section.

The invention, together with additional features and advantages thereof may best be understood by reference to the following description taken in connection with the accompanying illustrative drawings.

DESCRIPTION OF THE PREFERRED EMBODIMENT

Figure 1:
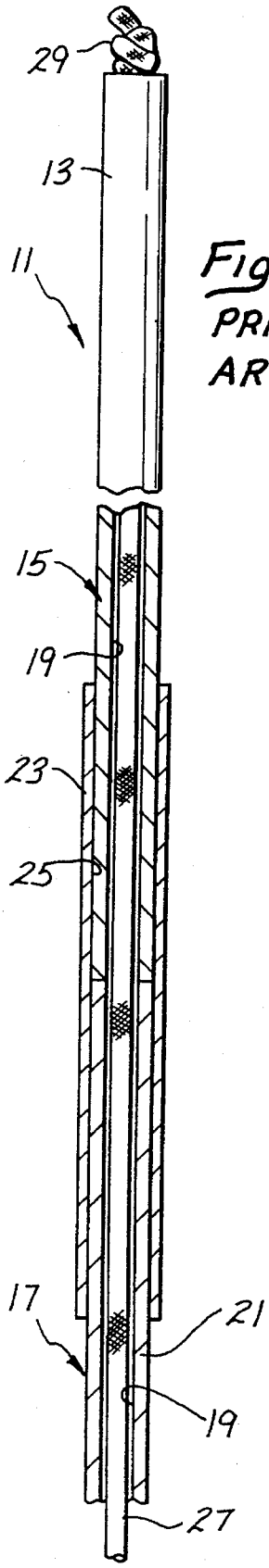
Fig. 1 PRIOR ART
FIG. 1 is a fragmentary elevational view partially in section of a prior art tent pole which utilizes the shock cord system.

FIG. 1 shows a prior art tent pole 11 which comprises a number of tent pole sections including end pole section 13 and a plurality of intermediate pole sections including pole sections 15 and 17. Each of the pole sections 13, 15 and 17 has a passage 19 which extends axially complete through the pole section. The pole section 17 includes an elongated member 21 and a ferrule 23 suitably affixed to an end portion of the elongated member and extending beyond the elongated member to define an axially opening cavity 25. An end portion of the pole section 15 is slidably received in the cavity 25. A resilient member in the form of an elongated, flexible, resilient cord 27 extends through the passages 19 of each of the pole sections and has a knot 29 at each end (only one being shown in FIG. 1) which is too large to pass through the passages 19. Consequently, the resilient cord 27 is tensioned so that it can resiliently urge the end portion of the pole section 15 into the cavity 25.

The construction shown in cross section in FIG. 1 is typical at each joint or junction between pole sections such that the cord 27 resiliently holds all of the pole sections in the essentially linear relationship shown in FIG. 1. However, the cord 27 allows the end portion of the pole section 15 to be axially withdrawn from the cavity 25 against the biasing action of the cord 27. The other joints of the tent pole 11 can be similarly disconnected. When disconnected, the cord 27 is sufficiently flexible to be folded to allow the pole sections to be in side-by-side relationship.

Figure 2:
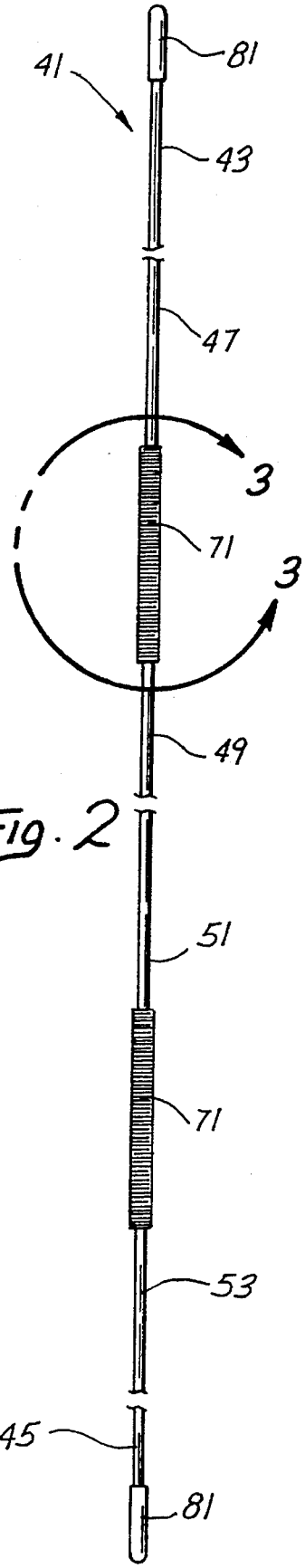
FIG. 2 is an elevational view of one form of tent pole constructed in accordance with the teachings of this invention.

FIG. 2 shows a preferred embodiment of tent pole of this invention. The tent pole 41 includes end pole sections 43 and 45 and a plurality of identical intermediate pole sections, such as the intermediate pole sections 47, 49, 51 and 53. The tent pole 41 may comprise any desired number of the intermediate pole sections.

Figure 3:
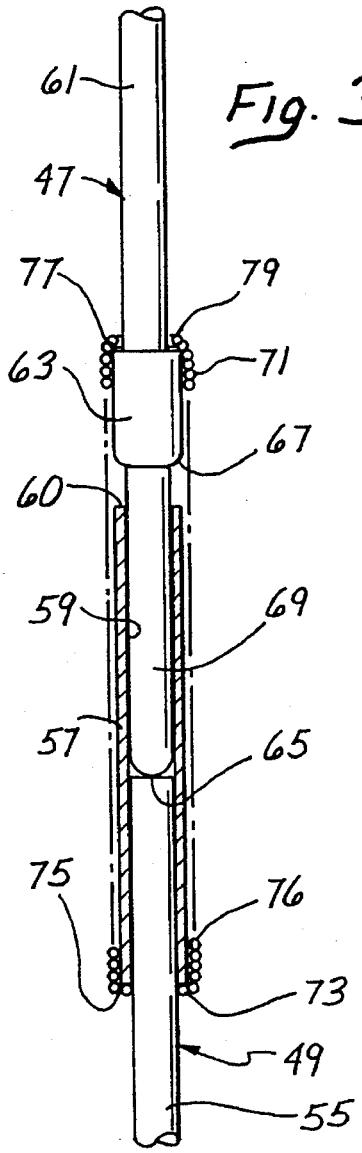
FIG. 3 is an enlarged elevational view partially in section illustrating the region of FIG. 2 identified by the arrow 3—3 of FIG. 2.

The intermediate pole sections are identical to each other, and so only portions of the intermediate pole sections 47 and 49 are shown in FIG. 3. The pole section 49 includes an elongated member or rod 55 constructed of a suitable tent pole material such as fiberglass and a ferrule 57 coupled, preferably by an adhesive, to an end portion of the elongated member and extending beyond the end of the elongated member to define an axially opening cavity 59 at one end 60 of the pole section 49. The elongated member 55 is devoid of a passage extending axially completely through the pole section, and in the embodiment illustrated, the elongated member 55 has no axially extending passage whatsoever. In the embodiment illustrated, the elongated member 55 is generally cylindrical and has a diameter of no more than about 4.5 millimeters over its entire length.

The ferrule 57 may have, for example, an internal diameter of about 4.5 millimeters and an outside diameter of from about 5.5 to 5.8 millimeters. In one preferred construction, the ferrule is approximately 4 centimeters in length and approximately one half of the length of the ferrule extends beyond the end of the elongated member 55. The ferrule may be constructed of, for example, plated metal, stainless steel or aluminum.

The pole section 47 comprises an elongated member 61, which may be identical to the elongated member 55, and a sleeve 63 which is preferably constructed of a suitable metal, such as plated metal, stainless steel or aluminum. Preferably, the material of the sleeve 63 is the same as that of the ferrule 57. The elongated member 61 has a rounded end 65 which is preferably smoothed by sanding. The sleeve 63 is affixed to the elongated member 55 in any suitable manner such as by an adhesive with the sleeve being spaced from the end 65. Preferably, the sleeve 63 has a beveled end 67 facing the end 65. By way of example, the sleeve 63 may be about 1 centimeter in length and spaced about 27 millimeters from the end 65. Further by way of example, the sleeve may have an I.D. of about 4.5 millimeters and an O.D. which is about 0.3 millimeter greater than the O.D. of the ferrule 57. An end portion 69, including the end 65 is received in the cavity 59 as shown in FIG. 3. Of course, the end region of the pole section 49 not shown in FIG. 3 is identical to the end region of the pole section 47 shown in FIG. 3, and conversely, the end region of the pole section 47 not shown in FIG. 3 is identical to the end region of the pole section 49 which is shown in FIG. 3.

Figure 4:
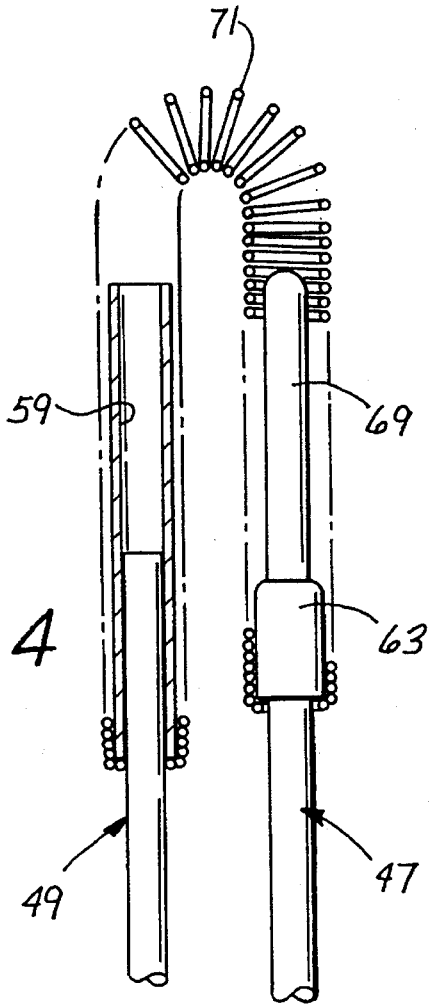
FIG. 4 is an view similar to FIG. 3 illustrating the folded condition of the tent pole.

A resilient member in the form of a coil spring 71 extends over portions of the outer surfaces of the pole sections 47 and 49 adjacent the end 60 of the pole section 49. The end 60 is also the distal end of the ferrule 57. The spring 71 is coupled to the pole sections 47 and 49 so that when the end portion 69 of the pole section 47 is received in the cavity 59, the coil spring 71 resiliently retains such end portion 69 in the cavity. The coil spring 71 also allows the end portion 69 to be axially withdrawn from the cavity 59 against the biasing force of the coil spring. The coil spring 71 is sufficiently flexible so that when the end portion 69 is withdrawn from the cavity 59, the coil spring can be folded as shown in FIG. 4 to allow the pole sections 47 and 49 to be in side-be-side relationship.

Both the ferrule 57 and the sleeve 63 form enlargements, and these enlargements can be advantageously used in coupling the spring 71 to the pole sections 47 and 49. For example, the coil spring 71 extends over at least a portion of the ferrule 57, and in the embodiment illustrated over the entire ferrule, and is preferably coupled to the ferrule by having at least one turn or coil 73 of reduced internal diameter which is engageable with the enlargement formed by the ferrule. More specifically, the proximal end of the ferrule 57 forms a shoulder 75 and the turn 73 of the spring 71 engages the shoulder 75 to couple the spring to the pole section 49 such that the spring can resist an outward axial pulling force. Preferably, approximately three turns or coils 73 are wound down to a smaller inside diameter with one of the coils being a transition coil and the other two having the fully reduced inside diameter. In the embodiment illustrated, the turns 73 of the spring 71 are wound down to an inside diameter of about 4.5 millimeters.

The spring 71 extends over at least a portion of the sleeve and preferably over the entire length of the sleeve and is coupled to the sleeve. When in the position of FIG. 3, the spring loosely receives the sleeve. The sleeve 63 also provides a shoulder 77, and at least one coil or turn 79 is wound down to a reduced internal diameter which is engageable with the shoulder 77 to couple the spring 71 to the pole section 47. By way of example, in this embodiment, the 1.5 turns 79 are wound down to approximately 5.5 millimeters in inside diameter whereas the main body 76 of the spring 71 has an inside diameter of about 6 millimeters. Of course, any number of the turns of the coil spring 71 may be wound down to the reduced diameter to provide the desired interlock with the shoulders 75 and 77. The coil spring 71 is further retained when extended because the act of extending the spring when, for example, separating the poles, decreases the internal diameter of the spring to the point that it may bind on the exterior surface of sleeve 63. This reduces the force against shoulder 77 needed to be exerted by wound down coil 79 to locate the spring. When attached in this fashion, the spring 71 is preloaded such that in the position shown in FIG. 3, there is a spring force urging the end portion 69 into the cavity 59. From the foregoing, it is also apparent that one end of the spring 71 is of a smaller inside diameter than the other for reasons described below.

By way of example and not by way of limitation, the spring 71 may be 17-7 stainless steel and have a wire diameter of about 0.6 millimeter. The overall length of the spring 71 may be about 52.5 millimeters with the main body 76, i.e. the unwound down coils of the spring being about 50 millimeters in length.

Each of the end pole sections 43 and 45 has either a sleeve or a ferrule at its inner end for connection with the adjacent intermediate pole section and an end cup 81 of a suitable polymeric material suitably adhered to its outer end.

Figure 5:
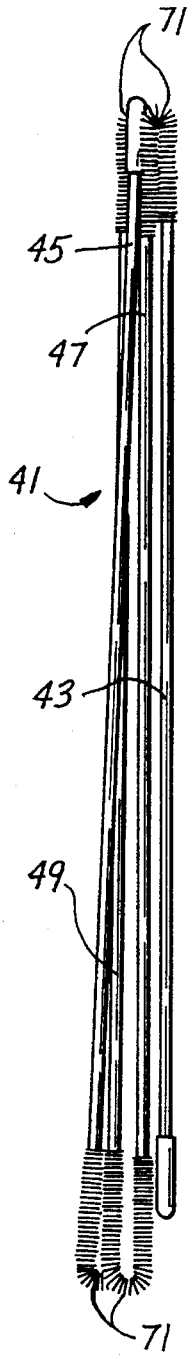
FIG. 5 is an elevational view illustrating the tent pole in the folded condition.
Figure 6:
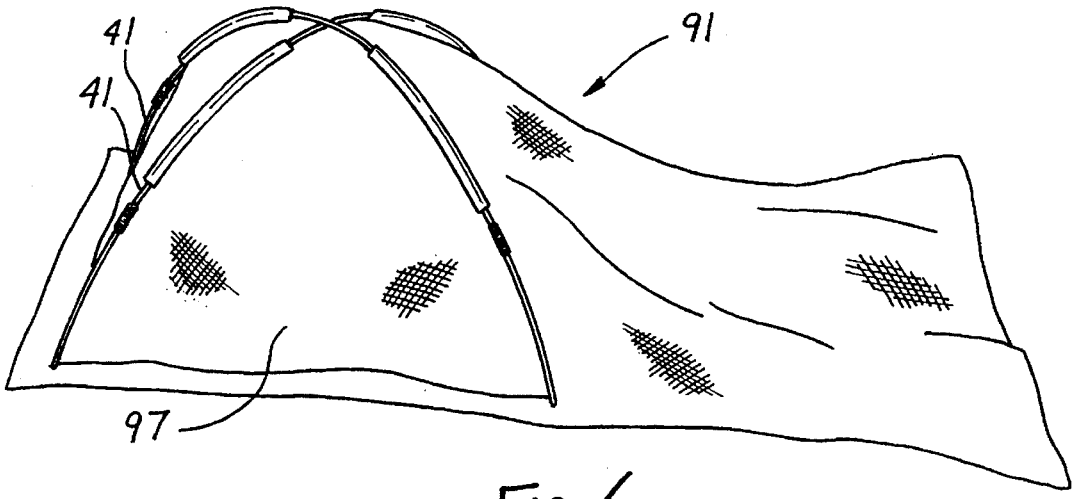
FIG. 6 is a perspective view of a tent utilizing the tent poles of this invention.

The tent pole 41 may be stored as shown in FIG. 5 in which each of the end portions 69 is removed from the associated cavity 59 as shown in FIG. 4 and the springs are each resiliently folded and held in a U-shaped configuration to place all of the tent pole sections in side-by-side relationship. When the pole sections are separated as in FIG. 4 spring 71 is extended and its internal diameter reduced sufficiently to grip the associated sleeve 63 to augment the sleeve-spring attachment. In use, the tent pole 41 is self straightening when released and shaken as the springs 71 tend to draw each of the end portions 69 into the adjacent cavity 59 such that the pole sections are linearly arranged as shown in FIG. 2. The rounded ends 65 are easily drawn into the associated cavities 59 to facilitate the self straightening of the tent pole 41. In this configuration, the tent pole 41 and other similar tent poles 41 can be utilized to erect a tent, such as the tent 91 which is illustrated purely by way of example. As such, the tent 91 comprises a frame 93 which in turn includes the tent poles 41. The tent 91 also includes a flexible sheet 95 supported by the frame to provide at least a partial enclosure 97.

To assemble the tent pole 41, each of the springs 1 is slid along the associated pole section (such as the pole section 49) with the large end, i.e. the end having the turns 79, being slid over the ferrule 57. The smaller end of the spring 71 (the end with the turns 73) is stopped against the shoulder 75 of the ferrule 57. The larger end of the spring 71 with the turns 79 is then slid and twisted over the associated sleeve 63 to place the turns 79 against the shoulder 77. Assembly in this fashion is made possible by having one end of the spring 71 of smaller internal diameter than the other end of the spring.

Although an exemplary embodiment of the invention has been shown and described, many changes, modifications and substitutions may be made by one having ordinary skill in the art without necessarily departing from the spirit and scope of this invention.

I claim:

1. A tent pole comprising:

first and second elongated pole sections, each of said pole sections having an outer surface;

one end portion of said first pole section having a cavity which opens axially at one end of the first pole section, one end portion of said second pole section being receivable in said cavity;

a resilient member extending over portions of the outer surfaces of the first and second pole sections adjacent said one end of the first pole section, said resilient member being coupled to the first and second pole sections so that when said one end portion of the second pole section is received in said cavity the resilient member resiliently retains such one end portion of the second pole section in said cavity, such one end portion being withdrawable from said cavity against the biasing force of the resilient member; and said resilient member being sufficiently flexible so that when said one end portion of said second pole section is withdrawn from the cavity the resilient member can be folded to allow the first and second pole sections to be in side-by-side relationship.

2. A tent pole as defined in claim 1 wherein at least one of the pole sections includes an enlargement and the resilient member is coupled to the enlargement.

3. A tent pole as defined in claim 1 wherein the second pole section includes an elongated member and a sleeve affixed to the elongated member and the resilient member is coupled to the sleeve.

4. A tent pole as defined in claim 1 wherein the first pole section includes an elongated member and a ferrule coupled to the elongated member and defining said cavity, said resilient member being coupled to said ferrule.

5. A tent pole as defined in claim 1 wherein at least one of said first and second pole sections is devoid of a passage extending axially completely through such pole section.

6. A tent pole as defined in claim 1 wherein each of said first and second pole sections has a diameter of no more than about 4.5 millimeters over substantial lengths of such pole sections.

7. A tent pole comprising:

first and second elongated pole sections, each of said pole sections having an outer surface;

one end portion of said first pole section having a cavity which opens axially at one end of the first pole section, one end portion of said second pole section being receivable in said cavity and withdrawable from said cavity;

a coil spring extending over at least regions of said outer surfaces of said one end portions of said first and second pole sections;

said coil spring being coupled to the first and second pole sections so as to resiliently resist axial separation of the pole sections when said one end portion of the second pole section is received in said cavity; and said coil spring being sufficiently flexible so that when said one end portion of said second pole section is withdrawn from the cavity the coil spring can be folded to allow the first and second pole sections to be in side-by-side relationship.

8. A tent pole as defined in claim 7 wherein at least one of the pole sections includes an enlargement and the resilient member is coupled to the enlargement.

9. A tent pole as defined in claim 8 wherein the coil spring has at least one turn of reduced internal diameter which is engageable with the enlargement to couple the coil spring to said one pole section.

10. A tent pole as defined in claim 7, wherein the second pole section includes an elongated member and a sleeve affixed to the elongated member, the coil spring extends over at least a portion of the sleeve and is coupled to the sleeve.

11. A tent pole as defined in claim 10 wherein the sleeve provides a shoulder and the coil spring has at least one turn of reduced internal diameter which is engageable with the shoulder to couple the coil spring to said second pole section.

12. A tent pole as defined in claim 7 wherein the second pole section includes an elongated member and a sleeve affixed to the elongated member, said one end portion of the second pole section includes one end of the elongated member of the second pole section, said sleeve is spaced from said one end of the elongated member of the second pole section and has a beveled end facing said one end of the second pole section.

13. A tent pole as defined in claim 7 wherein the second pole section includes an elongated member and a sleeve affixed to the elongated member, said one end portion of the second pole section includes one end of the elongated member of the second pole section, said sleeve is spaced from said one end of the elongated member of the second pole section and said one end of the elongated member of the second pole section is smooth and rounded.

14. A tent pole as defined in claim 7 wherein the first pole section includes an elongated member and a ferrule coupled to the elongated member and defining said cavity, the coil spring extends over at least a portion of the ferrule and is coupled to the ferrule.

15. A tent pole as defined in claim 14 wherein the ferrule provides a shoulder and the coil spring has at least one turn of reduced internal diameter which is engageable with the shoulder to couple the coil spring to said one pole section.

16. A tent pole as defined in claim 15 wherein the second pole section includes an elongated member and a sleeve affixed to the elongated member, the coil spring extends over at least a portion of the sleeve, the sleeve provides a shoulder and the coil spring has at least one turn of reduced internal diameter which is engageable with the shoulder of the sleeve to couple the coil spring to said one pole section.

17. A tent pole as defined in claim 16 wherein the internal dimensions of the coil spring decrease when the spring is extended to separate the first and second pole sections so the spring grips the sleeve.

18. A tent pole as defined in claim 16 wherein said turn of the coil spring which is engageable with the shoulder of the ferrule has a smaller internal diameter than the turn of the coil spring which is engageable with the shoulder of the sleeve.

19. A tent comprising:

a frame;

a flexible sheet supported by the frame to provide at least a partial enclosure;

said frame including at least one tent pole; and said tent pole comprising first and second elongated pole sections, each of said pole sections having an outer surface, one end portion of said first pole section having a cavity which opens axially at one end of the first pole section, one end portion of said second pole section being receivable in said cavity, a resilient member extending over portions of the outer surfaces of the first and second pole sections adjacent said one end of the first pole section, said resilient member being coupled to the first and second pole sections so that when said one end portion of the second pole section is received in said cavity the resilient member resiliently retains such one end portion of the second pole section in said cavity, such one end portion being withdrawable from said cavity against the biasing force of the resilient member and said resilient member being sufficiently flexible so that when said one end portion of said second pole section is withdrawn from the cavity the resilient member can be folded to allow the first and second pole sections to be in side-by-side relationship.

20. A tent as defined in claim 19 wherein the resilient member includes a coil spring extending over at least regions of said outer surfaces of said one end portions of said first and second pole sections.

21. A tent as defined in claim 20 wherein at least one of the pole sections includes an enlargement and the coil spring has at least one turn of reduced internal diameter which is engageable with the enlargement to couple the coil spring to said one pole section so that when said one end portion of said second pole section is withdrawn from the cavity the resilient member can be folded to allow the first and second pole sections to be in side-by-side relationship.

22. A tent pole as defined in claim 1 wherein the first pole section provides an abutment which is engaged by the second pole section when said one end portion of the second pole section is received in said cavity.

* * * * *